US010194759B1

(12) United States Patent
Didur

(10) Patent No.: US 10,194,759 B1
(45) Date of Patent: Feb. 5, 2019

(54) ULTRAVIOLET SHADOW BOX

(71) Applicant: FINESSE DIAMOND CORP., New York, NY (US)

(72) Inventor: David F. Didur, Toronto (CA)

(73) Assignee: FINESSE DIAMOND CORP., New York, NY (US)

( * ) Notice: Subject to any disclaimer, the term of this patent is extended or adjusted under 35 U.S.C. 154(b) by 0 days.

(21) Appl. No.: 16/009,935

(22) Filed: Jun. 15, 2018

(51) Int. Cl.

| | |
|---|---|
| ***F21V 19/00*** | (2006.01) |
| ***F21V 23/04*** | (2006.01) |
| ***A47F 11/10*** | (2006.01) |
| ***F21V 33/00*** | (2006.01) |
| ***F21S 4/00*** | (2016.01) |
| ***A47F 3/00*** | (2006.01) |
| ***F21V 23/00*** | (2015.01) |
| *F21Y 115/10* | (2016.01) |

(52) U.S. Cl.
CPC ..... *A47F 11/10* (2013.01); *A47F 3/001* (2013.01); *F21S 4/00* (2013.01); *F21V 23/003* (2013.01); *F21V 33/0032* (2013.01); *F21Y 2115/10* (2016.08)

(58) Field of Classification Search
CPC ..... F21V 33/0028; F21V 9/30; F21V 3/00; F21V 15/01; F21V 14/00; F21W 2121/00
See application file for complete search history.

(56) References Cited

U.S. PATENT DOCUMENTS

| | | | | |
|---|---|---|---|---|
| 3,944,368 | A | 3/1976 | Beesley | |
| 5,329,433 | A | 7/1994 | Geeting et al. | |
| 6,405,858 | B1 | 6/2002 | Gagliardi | |
| 6,776,281 | B2 | 8/2004 | Ovadia | |
| 7,325,940 | B2 | 2/2008 | Cea et al. | |
| 7,959,320 | B2 * | 6/2011 | Mueller | A45D 42/10 362/231 |
| 8,403,517 | B1 | 3/2013 | Cox et al. | |
| 8,878,145 | B1 | 11/2014 | Liu | |
| 9,546,777 | B2 | 1/2017 | Didur | |

(Continued)

OTHER PUBLICATIONS

Moses, Thomas M. et al., "A Contribution to Understanding the Effect of Blue Fluorescence on the Appearance of Diamonds," pp. 244-259, Gems & Gemology, Winter 1997.

(Continued)

*Primary Examiner* — Tracie Y Green
(74) *Attorney, Agent, or Firm* — Banner & Witcoff, Ltd.

(57) ABSTRACT

A box is provided for displaying items, at least one of which is an ultraviolet-reactive item. The box is sized for insertion into a showcase. The box includes a box structure for containing the items to be displayed, and has at least one shadowing surface, and at least one open or glazed surface. Lighting is provided that is wired with the box structure, and includes a 365 nm ultraviolet LED diode assembly in an adjustable strip. A means is provided for directing the position or orientation of the adjustable strip so that the ultraviolet LED stimulates visible fluorescence in the ultraviolet-reactive item, while areas in the box are subject to ambient or showcase white light penetrating into the box structure through the at least one open or glazed surface; and areas in the box are subject to shadowing from the at least one shadowing surface.

12 Claims, 9 Drawing Sheets
(1 of 9 Drawing Sheet(s) Filed in Color)

(56) References Cited

U.S. PATENT DOCUMENTS

| | | | | |
|---|---|---|---|---|
| 2003/0167795 | A1* | 9/2003 | Metcalfe ..... | A44C 15/0015 63/1.14 |
| 2004/0141320 | A1 | 7/2004 | Bock et al. | |
| 2004/0213088 | A1 | 10/2004 | Fuwausa | |
| 2007/0165408 | A1 | 7/2007 | Li | |
| 2015/0021497 | A1 | 1/2015 | Didur | |
| 2016/0178168 | A1 | 6/2016 | Didur | |

OTHER PUBLICATIONS

"Display Techniques | FMS—The Fluorescent Mineral Society," 6 pages, [Online] https://uvminerals.org/fms/display-techniques, retrieved Jun. 14, 2018.

* cited by examiner

ULTRAVIOLET SHADOW BOX

FIELD OF THE INVENTION

The invention relates to boxes and showcases for displaying items, and more particularly relates to lighting and effects systems for such display boxes and showcases.

BACKGROUND

An interesting property of ultraviolet radiation is its ability to stimulate the phosphors of certain reactive materials and substances so as to produce a visually striking effect through the fluorescence of the material or substance.

The existence of phosphors in certain gemstones (e.g. diamonds) has been known to jewelers and gemologists for many years. In the case of diamonds, phosphors may be present in the form of impurity atoms of nitrogen, hydrogen and boron. These phosphors are largely undetectable in natural light conditions. However, under ultraviolet light, the phosphors may fluoresce in shades of orange, blue, yellow or green. Fluorescence refers to the property of a substance to emit light through absorbed UV radiation, while exposed to the source of the UV radiation. The Gemological Institute of America has estimated that approximately 25% to 35% of diamonds have some degree of fluorescence. Diamonds containing phosphors in different concentrations may be virtually indistinguishable from each other in natural light, but become differentially fluoresced when exposed to ultraviolet radiation. The fluorescence appears as the emitting of lumens directly from the gemstone.

When present in strong concentrations, the presence of these phosphors has been associated with flawed or lower quality stones. Thus, fluorescence has been used as a grading and descriptive tool by jewelers and gemologists. Ultraviolet inspection lights are typically used under laboratory conditions where outside light is blocked out. Such ultraviolet lights are not used in the presence of customers or in a store setting with typically bright ambient lighting. Further, the perceived negative value of the fluorescent stones has meant that jewelers have sought to hide this feature from, or deemphasize it, to customers. Stones with Medium Blue or Strong Blue or Very Strong Blue fluorescence grades trade at very significant discounts. This effect has not been used in a display context where the phosphor containing properties of items were particularly highlighted or promoted.

A showcase is typically a glazed case or box, or cabinet for displaying and protecting items. It may be used in various contexts in a permanent or temporary installation to exhibit items (or a single item) in a particularly attractive or favorable aspect. Frequently, showcases are used to display items of a particular high value or rarity to enable the items to be examined more closely.

However, showcases have not historically been used to display the fluorescent properties of ultraviolet-reactive materials because it has been thought that such materials needed to be examined in extremely low light or preferably complete darkness in order for the ultraviolet radiation to have visible effect.

In applicant's patent application U.S. Ser. No. 15/636,878, options for new means of constructing or retrofitting showcases with combined white and UV light are provided (incorporated herein by reference). The applicant discovered that in fact ultraviolet radiation and white light can be used together without substantially compromising the ability to stimulate visible fluorescence of an ultraviolet-reactive item, allowing for a new experience for observers (e.g. prospective purchasers). Even in the presence of white light, the applicant discovered that the ultraviolet-reactive item can appear to spontaneously "pop" to the observer's attention.

However, showcases are a major investment item for store owners. Rather than replace such large items with new showcases having specialized lighting systems, many store owners would prefer to use existing showcases with existing lighting systems. Options should exist for providing substructures to insert into existing showcases to provide new and dramatic supplementary UV and white light display possibilities.

SUMMARY OF THE INVENTION

A box is provided for displaying items, at least one of which is an ultraviolet-reactive item. The box is sized for insertion into a showcase. The box includes a box structure for containing the items to be displayed, and has at least one shadowing surface, and at least one open or glazed surface (that is, an opening in the box that may or may not be glazed). Lighting is provided that is wired with the box structure, and includes: at least one adjustable strip including: a U-shaped extrusion, at least one compact ultraviolet LED assembly mounted on the extrusion, within which is disposed an LED circuit and a 365 nm ultraviolet LED diode disposed on the LED circuit, and a narrow band diffuser mounted across at least a portion of an open side of the extrusion and covering the LED assembly, and a controller for controlling the lighting. A means is provided for directing the position or orientation of the adjustable strip so that the ultraviolet LED stimulates visible fluorescence in the ultraviolet-reactive item, while areas in the box are subject to ambient or showcase white light penetrating into the box structure through the at least one open or glazed surface; and areas in the box are subject to shadowing from the at least one shadowing surface.

At least part of the lighting is preferably hidden within the box structure. The lighting may be obscured by the at least one shadowing surface.

The box structure preferably has a top portion and a base portion. At least part of the lighting may be mounted in the base portion (i.e. footlights). For example, the lighting may be mounted under the roof portion of the box, or along the side or end walls, and may be toward the bottom of said side or end walls as footlights.

Display mountings may be disposed in the box structure. Preferably, the adjustable strip is directionable toward an ultraviolet-reactive item on at least one of the mountings.

The adjustable strip may be delimited in its directionability to prevent directing ultraviolet radiation up through the glazed surface toward a viewer's eyes.

In some embodiments, the lighting further comprises a white light assembly wired with the ultraviolet LED assembly and mounted in the same extrusion. Preferably, the controller is programmable to selectively modulate power output of the ultraviolet LED assembly and the white light assembly.

The glazed surface may be a transparent, semitransparent, translucent or semitranslucent material.

The shadowing surface may be a solid structural component that is opaque, or that is an opaque portion of a glazing material, the shadowing surface being disposed at a distance from another surface on which a shadow is cast by the shadowing surface. The ultraviolet-reactive item may be disposed at least in part in the shadow cast by the shadowing surface.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

FIG. 10A shows views of the items in white light only. FIG. 10B shows the same items under influence of UV radiation showing emitted fluorescence of the stones.

DETAILED DESCRIPTION

The present shadow box is for use in a standard display case/showcase, of the type known for example to be used in jewelry stores and jewelry displays. The shadow box allows for a theatrical presentation of UV-reactive or UV-sensitive items using the combined effects of (i) selective shadowing; and (ii) UV LED to stimulate fluorescence of the items, resulting in a particularly striking and dramatic presentation. At the same time, ambient light (or daylight) and/or showcase lighting can enter into the shadow box to provide full visibility of the contents, which may also include non-UV-reactive items.

Items that exhibit fluorescence under ultraviolet radiation include ultraviolet-reactive gems, minerals, and even animals (e.g. fish), as well as, man-made items manufactured or coated with phosphoric chemicals, paints or dyes (e.g. candy/confections, toys, cosmetics, decorative accents on various products, display devices, labels, signage, and decorative items in regard to household and/or commercial display).

Figure 10A:
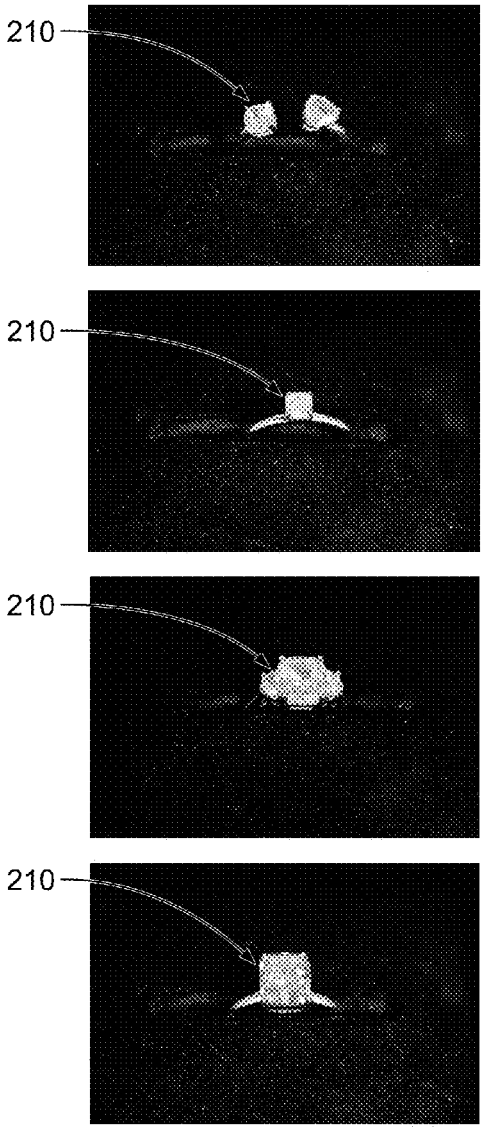
FIGS. 10A and 10B are photographic views of several sample UV-reactive items (here, diamonds).
Figure 10B:
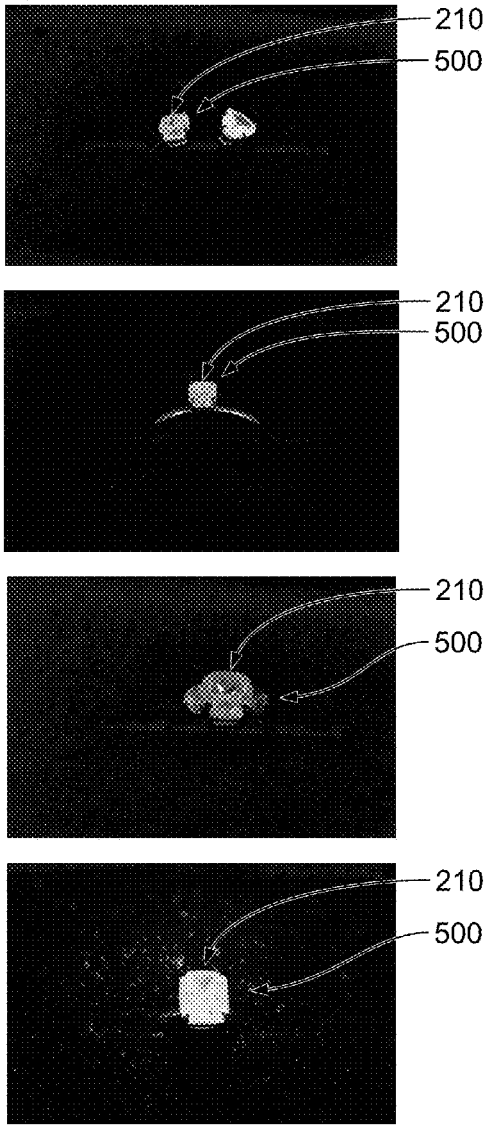

Some examples of such items 200 are shown in FIGS. 10A and 10B. The items (here, diamonds having naturally occurring phosphors) are shown in FIG. 10A in white light only, and in FIG. 10B with UV radiation. The diamonds present themselves in a unique and striking form. While under the effect of the ultraviolet radiation, the stones themselves emit visible illumination through their fluorescence 500. When the radiation source is shut off, the effect ceases.

A basic showcase is shown in FIGS. 1-8. The showcase 10 includes a structure or frame 20 (here, a case or cabinet) and a base 30 (here, with legs). As is known, the showcase has glazed walls 40, and a cabinet floor 50 (opaque or glazed). The showcase may include its own conventional lighting, or may be lit by ambient light or exterior spotlights (not shown). Although a conventional configuration is shown, it will be appreciated that any type of showcase structure can be used for the present invention—with or without a base; freestanding or built into another structure; and having any shape, dimension, number of walls or edges, so long as there is at least one surface having glazing (glass, plastic, etc.) through which contents of the showcase (here, shadow boxes and interior items for display) can be seen. The showcase may itself contain internal mountings 200 on which the items can be placed or presented or staged, or the mountings may be inside the shadow boxes 100. Such mountings 200 can include any type of risers, shelves, boxes, platforms, displays, holders, etc., whether removable or fixed.

Preferably, the showcase is provided with an open end, window, gate, etc. through which shadow boxes can be inserted into the showcase and positioned as desired.

Figure 1:
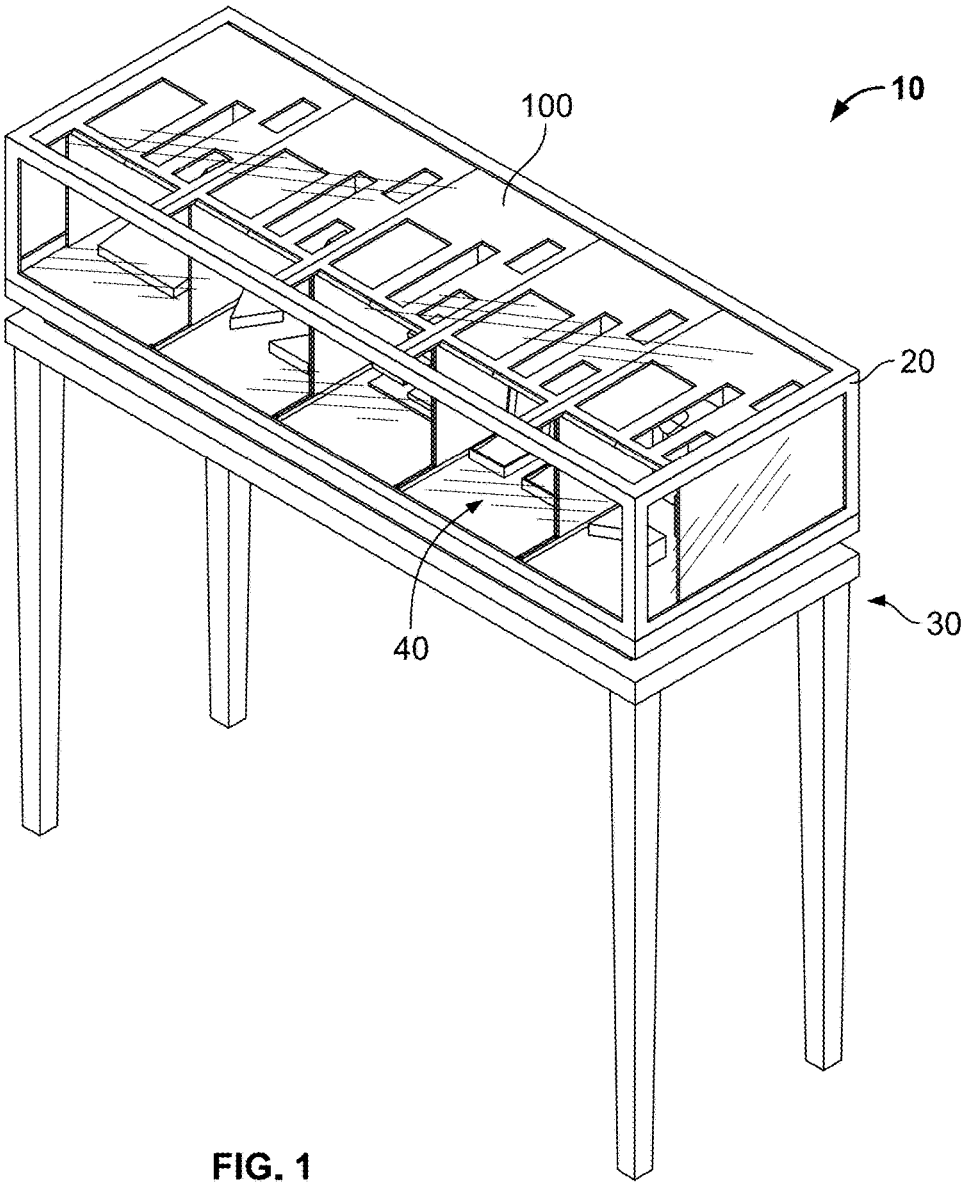
FIG. 1 is a perspective view of a showcase containing multiple shadow boxes according to a preferred embodiment.
Figure 2:
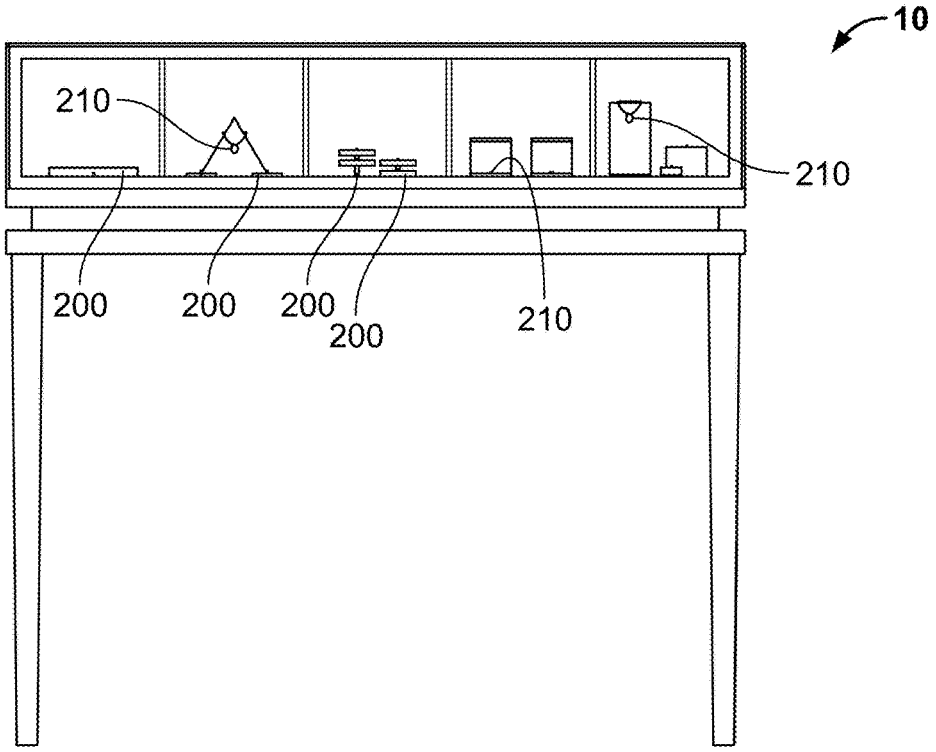
FIG. 2 is a front view of the showcase showing shadow boxes containing items for display.
Figure 3:
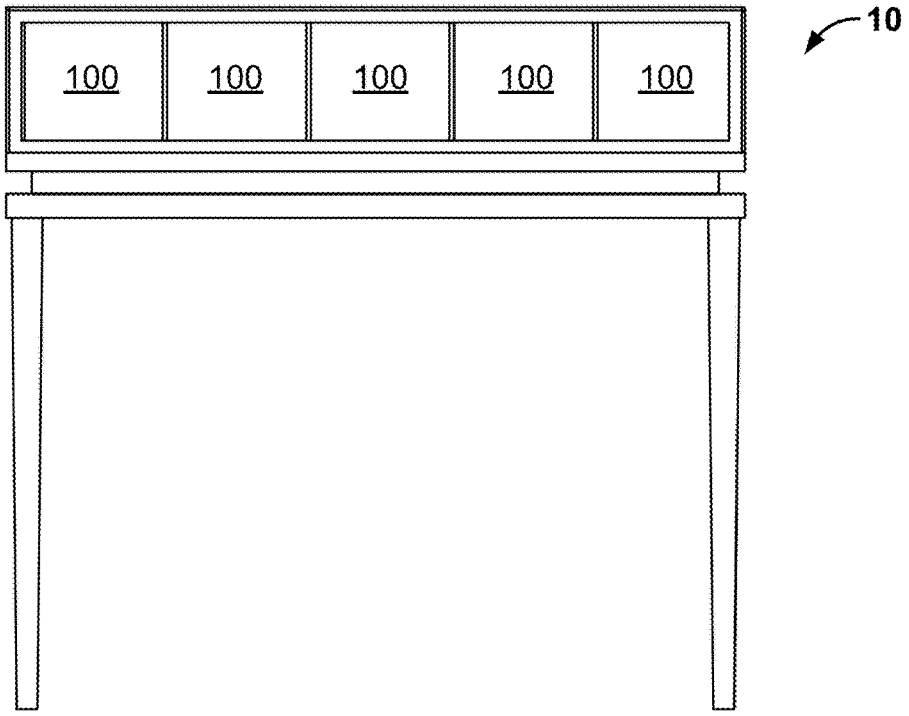
FIG. 3 is a front view of the showcase with items removed to show shadow box array.
Figure 4:
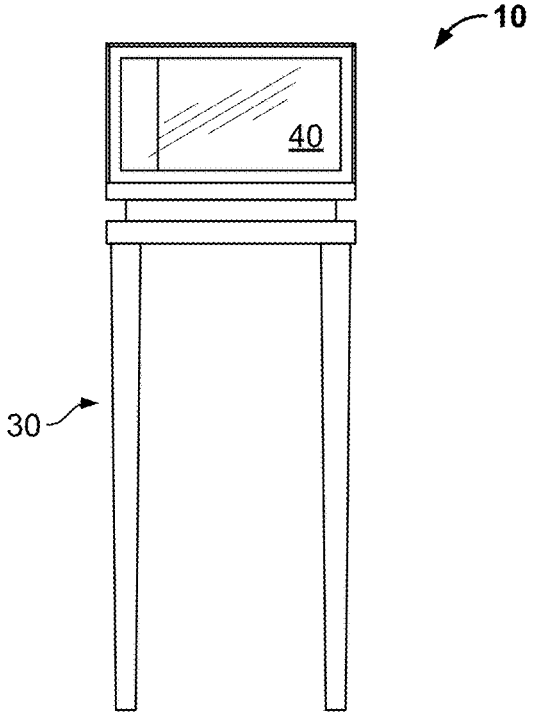
FIGS. 4 and 5 are end views of the showcase.
Figure 5:
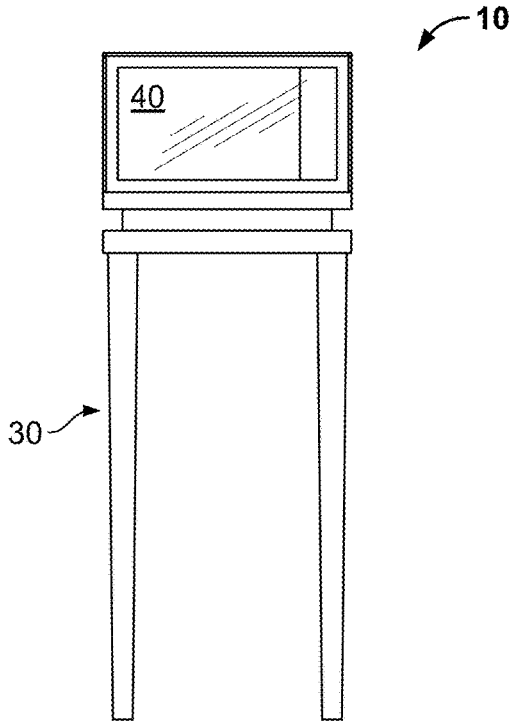
Figure 6:
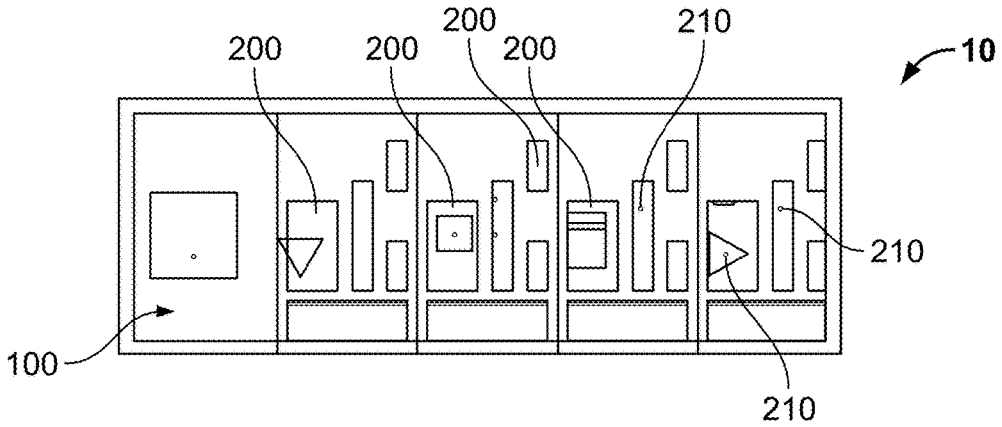
FIG. 6 is a top view of the showcase showing items for display (tops of shadow boxes removed for clarity).
Figure 7:
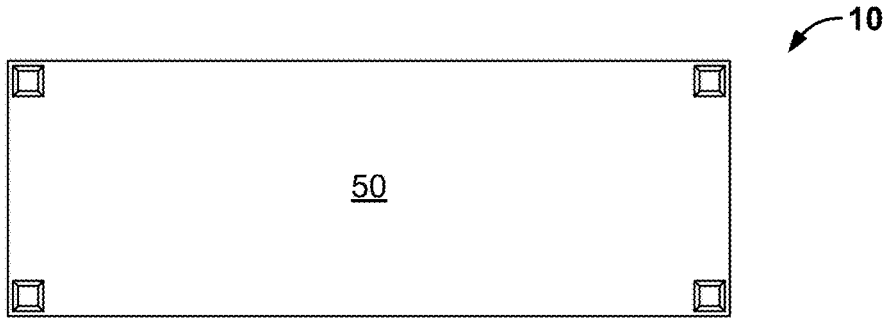
FIG. 7 is an underside view of the showcase.

As shown for example in FIG. 3, shadow boxes 100 for display inside such showcases 10 may be provided in a multi-box arrangement (e.g. linearly positioned as shown, or they be stacked or otherwise arrayed in any desirable arrangement).

Each shadow box serves as its own mini theatre in which a valuable item or items are presented. Thus, the showcase can have non-shadow box display items as well; where the shadow box is used to particularly highlight a very special item or items. In addition, the shadow boxes can include a combination of UV-reactive items 210 and non-UV-reactive items 220 mounted on various mountings 200. These set the feel of the scene, and provide theatrical settings and architectural devices to enhance the display (e.g. props, effects, surfaces).

Figure 8:
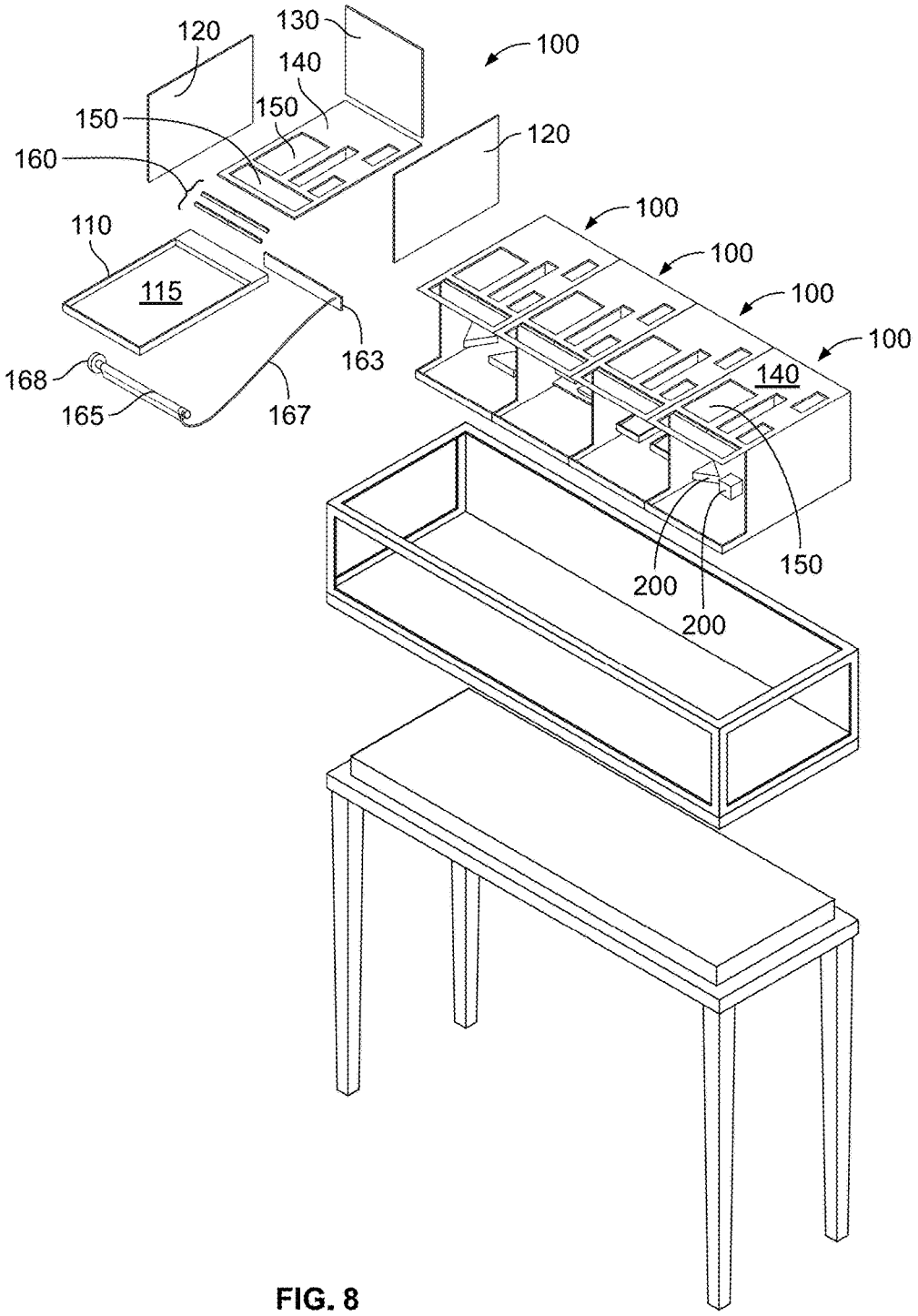
FIG. 8 is an exploded view of the showcase and shadow boxes.
Figure 9A:
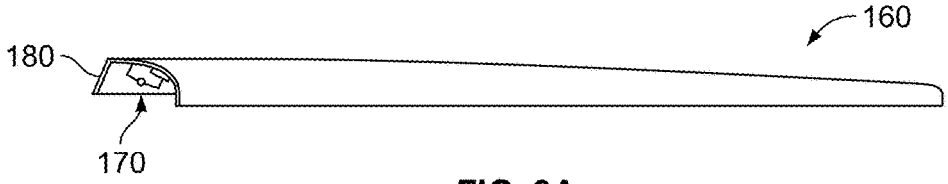
FIG. 9A is a perspective view of a lighting strip having U-shaped extrusion with one UV LED showing.
Figure 9B:
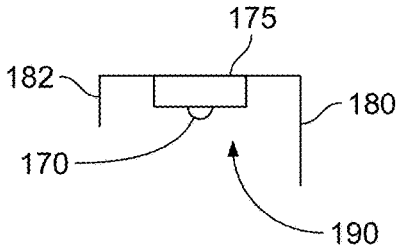
FIG. 9B is a sectional view of the lighting strip of FIG. 9A.
Figure 9C:
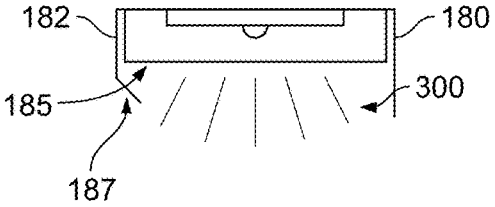
FIG. 9C is a sectional view of an embodiment of the lighting strip with narrow band diffuser (retained by flange).
Figure 9D:
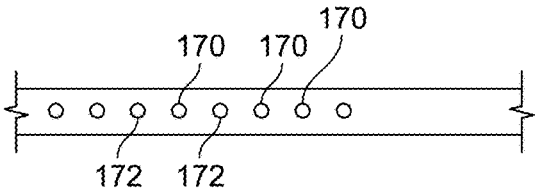
FIG. 9D is an interior view of the lighting strip with multiple UV and white light LEDs.
Figure 9E:
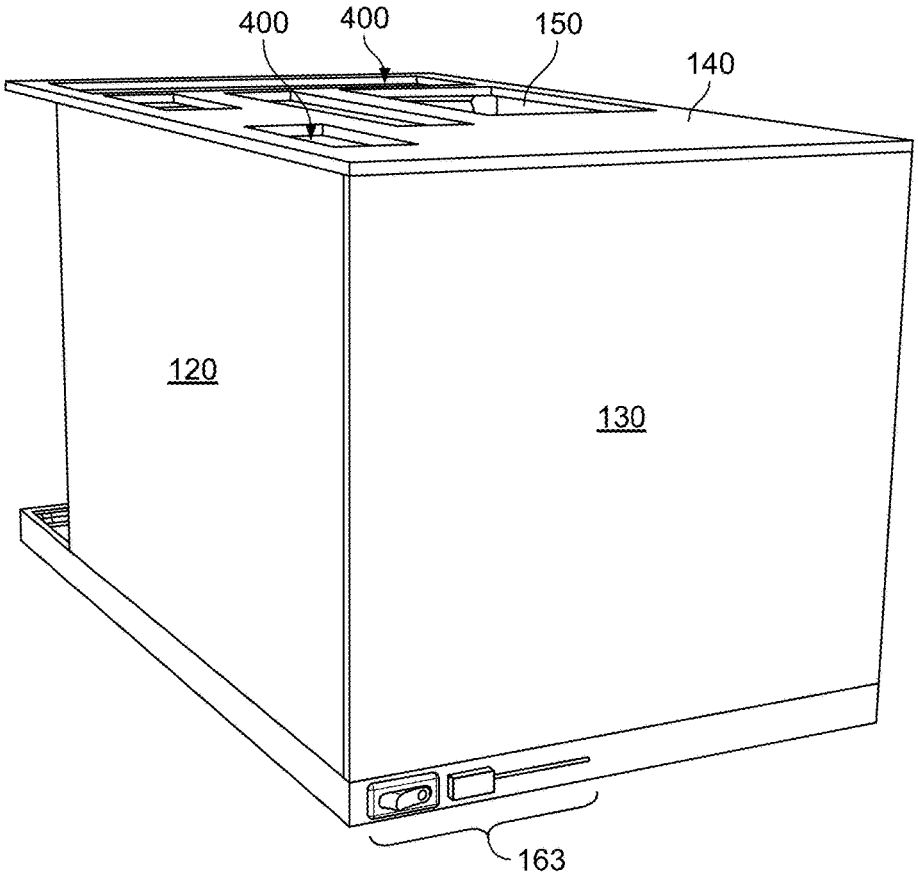
FIG. 9E is a rear view of the shadow box showing switch and controller.
Figure 9F:
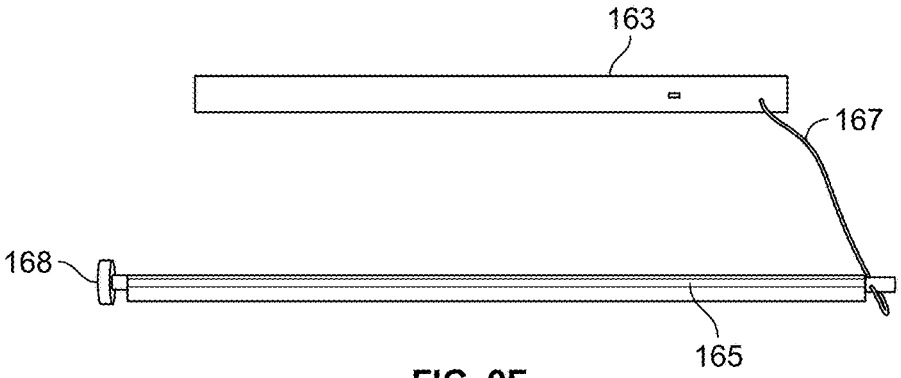
FIG. 9F is a simplified view of the lighting strip assembly with adjustment.

The structure of the shadow boxes can be seen in FIGS. 8 and 9E. In a basic embodiment, each box has a base 110, side walls 120, one or two end walls 130 and a top/roof 140. The base may be provided with openings 115 or an entirely open floor, so that the items displayed may be sitting on the base of the shadow box or on the floor 50 of the showcase itself (i.e. the shadow box may be structured so as to provide merely an overhead covering over the displayed items and their mountings. Although standard box shapes are shown as described, it is also contemplated that such "boxes" may in fact take various forms (e.g., to name only a few alternatives, cylindrical, spherical or hemispherical, pyramidal, and truncated versions of these. Further, the shadow box may not be completely enclosed, and any or most of the walls may in fact be omitted or reduced in dimension.

The walls of the shadow boxes may be opaque or clear, glazed or non-glazed. Any material that is rigid may be used. Some possible materials for the shadow boxes include, without limitation, rigid composites (e.g. Gatorboard, DiBond), metals, woods, plastics, etc. Entire walls may be themselves illuminated.

The walls and base may also be coated with coatings selected to achieve a particular effect in view of the lighting. For example, fluorescent paint may be used to provide another fluorescing surface that responds to the UV light, glossy finishes may better reflect ambient light, playing up the contrast with shadowed areas, and matte finishes (e.g. matte black) may absorb light, providing a different kind of contrast to show off fluorescent surfaces and items. Textiles may also be used in the shadow box to create a sumptuous or sensuous effect. Where particularly exposed to UV radiation, the coatings or surfaces may be chosen to be UV stable.

The roof 140 preferably has openings 150 that allow in ambient (e.g. natural white), external or showcase light. The structural parts of the roof surrounding these openings provide shadowing surfaces, that is, surfaces that cast a shadow on opposed surfaces and interior portions of the shadow box. Therefore, the distribution and shape of the openings can be used strategically to allow portals through which items in the box can be viewed. In addition, the surrounding slats or non-open areas can operate like a stencil so that specific selected areas are obscured or shadowed beneath the roof. It will be appreciated that other sides or ends of the shadow box may also have such openings. The openings may be glazed. The structural parts of the box may be any opaque material (or simply opaqued portions of a continuous surface with the "openings" which may be translucent).

In addition to providing natural openings through which light may pass, and closed areas for creating shadows, the structure of the shadow box may serve as a mounting structure for UV, and in some cases white, lighting.

The lighting preferably includes a lighting strip 160 which is wired to a controller 163 (including switch, dimmer, etc.), shown in very simplified form in FIG. 9E. The strips are preferably adjustable, dimmable and modulatable. In one example, white and UV light may be modulated. The controller in this case would operate to modulate the lumen intensity (relative "dimness" or "brightness") of both the ultraviolet (and if provided, white) light, in order to optimize an intensity (and/or mix) of light to best illustrate the items. The structure of the controller may include various programmable user controls, such as dials, sliders, etc.

Sample enhance functions of the controller may include user preprogrammed combinations of light. For example, special theatrical shimmer or magical effects can be produced, and other specific lighting patterns or "scenes". Further, timing effects (e.g. turn-on/shut-off timing) can be programmed in certain embodiments.

It will be appreciated that the shadow box lighting may be wired directly into the shadow box as a fixture (e.g. through defined channels, conduits or raceways in the shadow box). The controller 163 may be positioned in direct wired communication with the shadow box lighting (as shown in FIG. 9E, or it may be configured as a remote device, or even as an app that controls the shadow box lighting remotely.

The lighting strip 160 may have a generally U-shaped extrusion 180 (by which we intend to include V-shaped or hemispherical or flat-bottomed shapes) in which is mounted one or more UV LED assemblies. Each UV LED assembly has a circuit board 175 and a UV LED diode 170.

The UV LED preferably has the specific wavelength of 365 nanometers (nm). The diode is preferably a high-powered diode at 3 watts to better throw the UV energy within the shadow box. The applicant has found that this specific wavelength and this specific wattage is particularly effective to stimulate fluorescence of UV-reactive items, such as gemstones, and is a far superior effect than can be achieved with more commonly available household- or commercial-grade UV lights.

Where used, white lighting 172 may be provided (on the same strip, as shown in FIG. 9D, or a separate strip) through white light bulbs or diodes, preferably in the colour temperature range of 2800K to 5500K. The white light source can be LED, incandescent, halogen, xenon, etc.

The extrusion of the lighting strip may be provided with a narrow band diffuser to diffuse the UV radiation across a broader area (horizontally or vertically). In one example, the diffuser 185 may be a simple acrylic piece that slides onto flanges 187 or is retained by clips, etc. (not shown) on the extrusion edge(s) to at least partially cover the open side 190 of the extrusion.

In the energized state, the UV LED emits a beam of UV radiation that can be directed to strike the ultraviolet-reactive item. The invisible UV energy is in watts (here, preferably at least 3 watts), a radiometric output (i.e. the intensity of power output). The energy becomes visible fluorescence emitted by the item 210, as illustrated in the stones in FIG. 10B. The fluorescent light 500 emitted by the item 210 (examples in FIGS. 10A and 10B being gemstones) is a form of photometric output, which is typically measured in lumens depending on how bright the light appears to the human observer.

Power to the lighting strip(s) may be provided by AC line voltage to an integrated low voltage transformer. Alternatively, a USB connection may be used to power the lighting strips. In one embodiment, the system may be battery powered. Lithium ion cells of at least approximately 1000 mAh may be used to provide sufficient power for the high-powered diodes.

The structure of the shadow box means that the lighting strip can be mounted in various positions in the box (which may be hidden positions on the surfaces of the interior or built into millwork of the boxes). The shadow box allows for lighting strips to be positioned above and below the display items (e.g. like spotlights and "footlights" in a theater). The concern for avoiding aiming the UV radiation directly into the viewer's line of sight (damaging to the eyes) can be mitigated by the structure of the shadow box itself (i.e. the shadowing surfaces) or through positioning and orienting of the lighting strips. For example, the lighting strips may be provided with a simple adjustment mechanism 168 to direct the beam of the strip inwards toward the interior of the box, and delimiters (not shown) may be provided to restrict the range of adjustment. The adjustment may be manual or motorized. Where manual, they may be adjusted for example by a manual knob or wheel, or may turn with an allen key. Other means of adjustment can include flexible, retractable or telescoping positioning arms, variable height pendant lighting and various sliding mechanisms (not shown).

Figure 11:
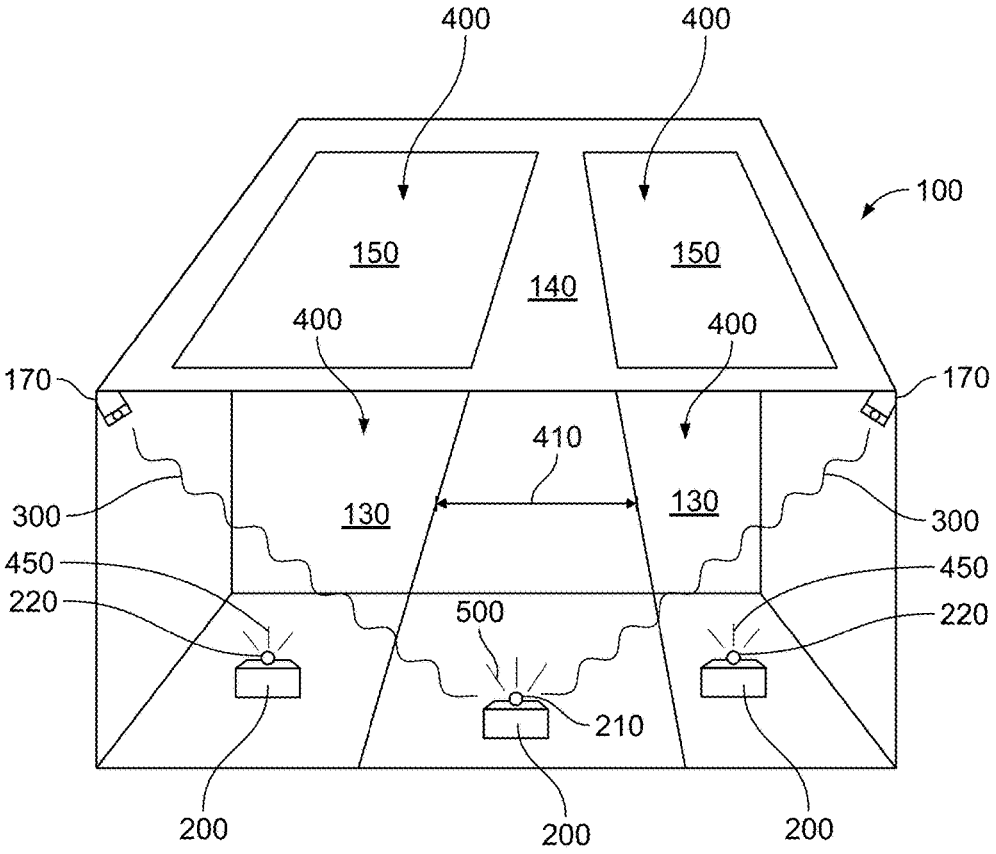
FIG. 11 is a front perspective (simplified) view of shadow box showing light and UV radiation effects as well as selective shadowing under portion of the shadow box roof.

FIG. 11 best illustrates the combined effects of the box shadowing, lighting and fluorescing effects. There are at least five types of light/energy activity happening simultaneously in the box (when powered):

- The openings (or glazed areas) 150 permit ambient, store or showcase lighting 400 to enter the box.
- This light in turn may be reflected as reflected light 450 from shiny items or surfaces in the box, such as the non-UV-reactive items 220.
- At the same time, other areas of the box may be under a penumbra or shadow 410 created by the non-open portions of the roof 140, which act as a shadowing surface.
- UV radiation is supplied by UV LEDs 170 in the lighting strips 160. These may be directed so that the UV radiation 300 strikes UV-reactive items 210. The UV itself is invisible.
- The UV-reactive items 210 under influence of the UV radiation 300 emit fluorescence 500 in a visible form.

The effect of the fluorescence can also be enhanced by placing the UV-reactive items in the shadow 410, which provides a spot that is slightly darker than ambient, while still being visible through the openings of the shadow box.

No particular dimensional limitations are intended. However, it will be appreciated that there is a decay over distance of the UV radiation. Therefore, at greater distances from the item to be stimulated, the power of the UV LEDs must also be greater (or the number of such LEDs increased).

Although the present invention has been disclosed with reference to specific forms and embodiments, it will be evident that a great number of variations may be made without departing from the spirit and scope of the present invention. For example, equivalent elements may be substituted for those specifically disclosed and certain features of the present invention may be used independently of other features—all without departing from the present invention as defined in the appended claims.

The invention claimed is:

1. A box for displaying items, at least one of which is an ultraviolet-reactive item, the box being sized for insertion into a showcase, and the box comprising:

a box structure for containing the items to be displayed, the structure including at least one shadowing surface, and at least one open or glazed surface;

lighting wired with the box structure, including:

at least one adjustable strip including:

a U-shaped extrusion, at least one compact ultraviolet LED assembly mounted on the extrusion, within which is disposed an LED circuit and a 365 nm ultraviolet LED diode disposed on the LED circuit, a narrow band diffuser mounted across at least a portion of an open side of the extrusion and covering the LED assembly, and a controller for controlling the lighting; and means for directing the position or orientation of the adjustable strip so that the ultraviolet LED stimulates visible fluorescence in the ultraviolet-reactive item, while areas in the box are subject to ambient or showcase white light penetrating into the box structure through the at least one open or glazed surface; and areas in the box are subject to shadowing from the at least one shadowing surface.

2. The box of claim 1, wherein at least part of the lighting is hidden within the box structure.

3. The box of claim 2, wherein the lighting is obscured by the at least one shadowing surface.

4. The box of claim 1, wherein the box structure has a top portion and a base portion, and at least part of the lighting is mounted in the base portion.

5. The box of claim 1, further comprising display mountings disposed in the box structure.

6. The box of claim 5, wherein the adjustable strip is directionable toward an ultraviolet-reactive item on at least one of the mountings.

7. The box of claim 1, wherein the adjustable strip is delimited in its directionability to prevent directing ultraviolet radiation up through the glazed surface toward a viewer's eyes.

8. The box of claim 1, wherein the lighting further comprises a white light assembly wired with the ultraviolet LED assembly and mounted in the same extrusion.

9. The box of claim 8, wherein the controller is programmable to selectively modulate power output of the ultraviolet LED assembly and the white light assembly.

10. The box of claim 1, wherein the glazed surface is a transparent, semitransparent, translucent or semitranslucent material.

11. The box of claim 1, wherein the shadowing surface is a solid structural component that is opaque, or that is an opaque portion of a glazing material, the shadowing surface being disposed at a distance from another surface on which a shadow is cast by the shadowing surface.

12. The box of claim 11, wherein the ultraviolet-reactive item is disposed at least in part in the shadow cast by the shadowing surface.

* * * * *